US007971756B2

(12) United States Patent
Wu et al.

(10) Patent No.: US 7,971,756 B2
(45) Date of Patent: Jul. 5, 2011

(54) FILTERING DEVICE AND RELATED WIRELESS COMMUNICATION RECEIVER

(75) Inventors: Tsan-Chou Wu, Taipei Hsien (TW); Wen-Tsai Tsai, Taipei Hsien (TW); Chih-Chang Ko, Taipei Hsien (TW)

(73) Assignee: Wistron NeWeb Corporation, Hsi-Chih, Taipei Hsien (TW)

( * ) Notice: Subject to any disclaimer, the term of this patent is extended or adjusted under 35 U.S.C. 154(b) by 200 days.

(21) Appl. No.: 12/475,609

(22) Filed: Jun. 1, 2009

(65) Prior Publication Data

US 2010/0073109 A1 Mar. 25, 2010

(30) Foreign Application Priority Data

Sep. 24, 2008 (TW) ..... 97136617 A

(51) Int. Cl.
*H01P 1/203* (2006.01)
*H01P 3/08* (2006.01)

(52) U.S. Cl. ..... 222/204; 333/219

(58) Field of Classification Search ..... 333/204, 333/219, 227, 228; 455/333, 327
See application file for complete search history.

(56) References Cited

U.S. PATENT DOCUMENTS

| | | | | |
|---|---|---|---|---|
| 4,719,435 | A * | 1/1988 | Maitre | 333/224 |
| 4,875,025 | A * | 10/1989 | Buoli | 333/230 |
| 5,321,374 | A * | 6/1994 | Uwano | 333/202 |
| 5,426,402 | A * | 6/1995 | Mariani | 333/205 |
| 5,821,836 | A * | 10/1998 | Katehi et al. | 333/202 |
| 6,876,276 | B2 * | 4/2005 | Amano et al. | 333/204 |
| 2007/0052502 | A1 * | 3/2007 | Koizumi et al. | 333/204 |
| 2009/0181635 | A1 * | 7/2009 | Yamada | 455/333 |

OTHER PUBLICATIONS

Gashinova et al., "Novel Band-Pass Filter Utilizing S-shaped Slot Line Resonators", 2003 IEEE MTT-S Digest, pp. 1081-1084.*

Ahn et al., "A Design of the Low-Pass Filter Using the Novel Microstrip Defected Ground Structure", IEEE Trans. on Microwave Theory & Techniques, vol. 49, No. 1, Jan. 2001, pp. 86-93.*

* cited by examiner

*Primary Examiner* — Seungsook Ham
(74) *Attorney, Agent, or Firm* — Winston Hsu; Scott Margo

(57) ABSTRACT

A filtering device includes an isolation substrate including a first plane and a second plane, a micro-strip line deposited on the first plane of the isolation substrate for transmitting signals, and a ground metal layer deposited on the second plane of the isolation substrate for providing grounding. A meander-shaped resonating cavity is formed in an area of the ground metal layer corresponding to an area of the micro-strip line, for generating a rejection band on the micro-strip line.

20 Claims, 15 Drawing Sheets

FILTERING DEVICE AND RELATED WIRELESS COMMUNICATION RECEIVER

BACKGROUND OF THE INVENTION

1. Field of the Invention

The present invention relates to a filtering device and related wireless communication receiver, and more particular, to a filtering device and related wireless communication receiver for reducing circuit layout area and increasing adjustability.

2. Description of the Prior Art

In a broadcast system, a superheterodyne receiver is the most widespread use receiver, which can execute carrier frequency adjustment (namely select a channel), filtering, and amplifying. In the superheterodyne receiver, signal is received by an antenna, and performed amplifying, RF (radio-frequency) filtering, IF (intermediate frequency) transformation, and finally, via one or more IF amplifying and filtering processes, transformed to a base frequency band for succeeding demodulation. Transforming RF to IF is always influenced by image frequency interference, and may cause some problems.

Please refer to FIG. 1, which is a schematic diagram of a superheterodyne receiver 10 according to the prior art. The superheterodyne receiver 10 includes an antenna 100, a low noise amplifier 102, an image reject filter 104, a mixer 106, a local oscillator 108, an IF low pass filter 110, and an IF amplifier 112. Below is a summary of an operation method of the superheterodyne receiver 10. An RF signal $V_{RF1}$ is received by the antenna 100, and is amplified to an RF signal $V_{RF2}$ via the low noise amplifier 102. Then, the image reject filter 104 filters out image frequency signals of the RF signal $V_{RF2}$, to generate a filtered RF signal $VF_{RF}$. Finally, the filtered RF signal $VF_{RF}$ is transformed to an IF band through the mixer 106 to output IF signal $V_{IF}$ via filtering of the IF low pass filter 110 and amplifying of the IF amplifier 112. The image reject filter 104 is used for removing interference of the image frequency. A cause of the image frequency is: two input frequencies $|f_{LO} \pm f_{IF}|$ both become a frequency $f_{IF}$ through the mixer 106. The frequency $f_{LO}$ is an oscillating-signal frequency of the local oscillator 108, and the frequency $f_{IF}$ is a frequency of the IF signal $V_{IF}$. Therefore, in the superheterodyne receiver 10, when a signal with spectrum corresponding to sides of a local oscillating signal goes through the mixer 106, the signals enter the same spectrum, and form an interference signal which lowers a signal to interference ratio, influences a desired received signal, and affects a receiving efficiency of the superheterodyne receiver 10. For solving the problem of image frequency interference, the most common method is to add a band pass filter in front of the mixer 106, i.e., the image reject filter 104, for filtering out the interference signal before entering the mixer 106, so as to lower the interference.

There are many methods for realizing the image reject filter 104 according to the prior art, for example, hairpin band pass filter, parallel-coupled line filter, etc. Please refer to FIG. 2, which is a schematic diagram of a hairpin band pass filter 20 according to the prior art. The hairpin band pass filter 20 is a transverse symmetry structure, which includes micro-strip ports IO_a and IO_b, and resonators RSN_1~RSN_n. The micro-strip ports IO_a and IO_b connect to a front-stage and a rear-stage circuit for receiving and outputting signals. A total length of each of the resonators RSN_1~RSN_n is half of a wavelength corresponding to a desired received signal, and the number "n" of the resonators RSN_1~RSN_n represents an order of the hairpin band pass filter 20. Therefore, a designer can vary the number "n" according to different demands.

Therefore, the hairpin band pass filter 20 can achieve a proper image frequency rejection effect via adjusting a total length, an amount, a width, etc of each of the resonators. However, in the hairpin band pass filter 20, the resonators occupy a large circuit board area and increase cost because each of the resonators is bend-shaped (or hairpin-shaped). Moreover, an ability of the hairpin band pass filter 20 for restraining noise is weak around sides of a pass band. In other words, when noise closes to an RF band, the noise may enter the circuit, and cause interference. In this situation, the prior art utilizes a matched network of a micro-strip line, such as an open stub with a total length equal to a quarter of wavelength, to generate a rejection band for restraining noise.

Please refer to FIG. 3, which is a schematic diagram of a micro-strip line open stub structure 30. The micro-strip line open stub structure 30 extends an open stub 300 having an open terminal in a transmission path (from input port PT_i to output port PT_o), to generate a rejection bandwidth. However, the rejection bandwidth generated by the open stub 300 is about 30%, and an effect of reducing bandwidth is poor. For example, please refer to FIG. 4 and FIG. 5, which are schematic diagrams of transmission coefficients and rejection bandwidths of the open stub 300 in different line widths. FIG. 4 shows curves of transmission coefficients, where curves TP_1~TP_5 respectively indicate the line widths being 0.1 mm, 0.15 mm, 0.2 mm, 0.25 mm and 0.3 mm. FIG. 5 shows curves of transmission coefficients of a resonant point and rejection bandwidths, where curves TP_HM and BW_RJ respectively indicate the line widths being 0.1 mm, 0.15 mm, 0.2 mm, 0.25 mm and 0.3 mm. Therefore, as can be seen from FIG. 4 and FIG. 5, the effect of the open stub 300 reducing bandwidth is not sufficient. In other words, an ability of the micro-strip line open stub structure 30 filtering out noise is not sufficient around the RF band; thereby noise cannot be filtered effectively.

SUMMARY OF THE INVENTION

Therefore, the present invention provides a filtering device and related wireless communication receiver.

The invention discloses a filtering device which includes an isolation substrate including a first plane and a second plane, a micro-strip line deposited on the first plane of the isolation substrate for transmitting signals, and a ground metal layer deposited on the second plane of the isolation substrate for providing grounding. A meander-shaped resonating cavity is formed in an area of the ground metal layer corresponding to an area of the micro-strip line, for generating a rejection band on the micro-strip line.

The invention further discloses a wireless communication receiver which includes an antenna used for receiving a wireless signal, a wave guide coupled to the antenna, for enhancing an electric wave of a certain frequency band in the wireless signal, a frequency down converter used for reducing a frequency of the wireless signal, to output an IF (intermediate-frequency) signal, a baseband processor used for processing the IF signal, and a filtering device. The filtering device includes an isolation substrate including a first plane and a second plane, a micro-strip line deposited on the first plane of the isolation substrate for transmitting signals, and a ground metal layer deposited on the second plane of the isolation substrate for providing grounding. A meander-shaped resonating cavity is formed in an area of the ground metal layer corresponding to an area of the micro-strip line, for generating a rejection band on the micro-strip line.

These and other objectives of the present invention will no doubt become obvious to those of ordinary skill in the art after reading the following detailed description of the preferred embodiment that is illustrated in the various figures and drawings.

DETAILED DESCRIPTION

Figure 6A:
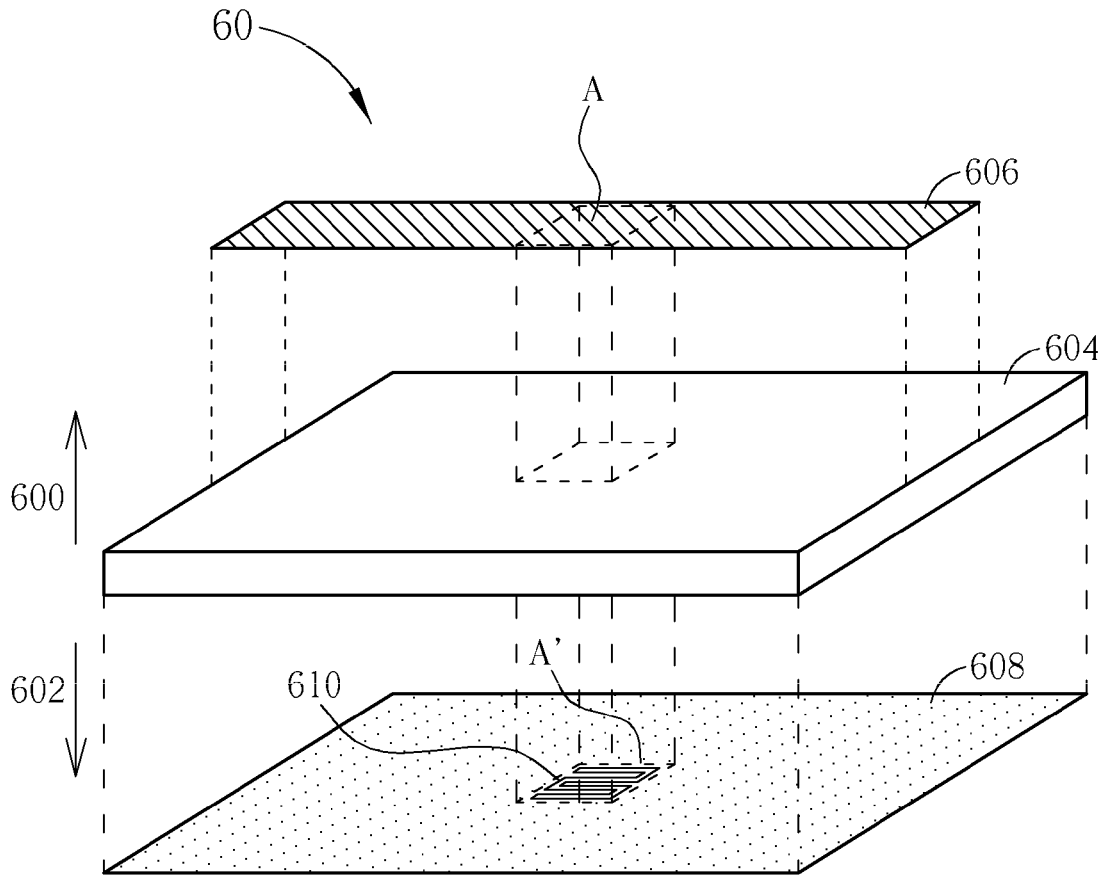
FIG. 6A is an exploded-view diagram of a filtering device according to an embodiment of the invention.
Figure 6B:
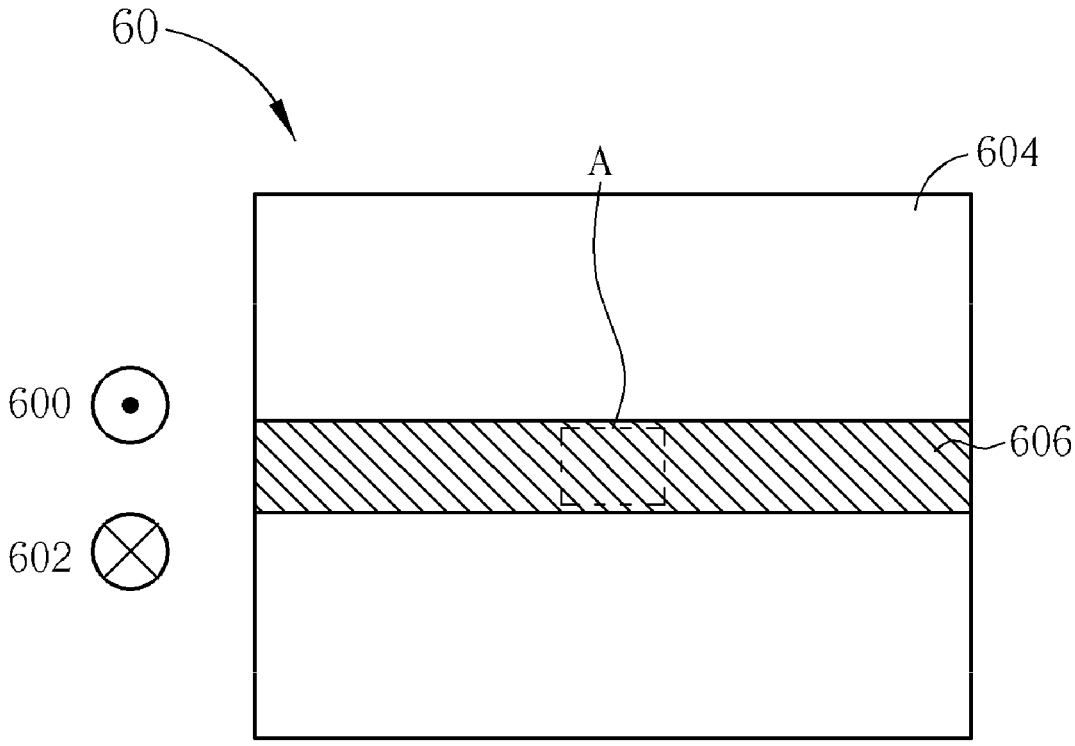
FIG. 6B is a vertical-view diagram of the filtering device shown in FIG. 6A.
Figure 6C:
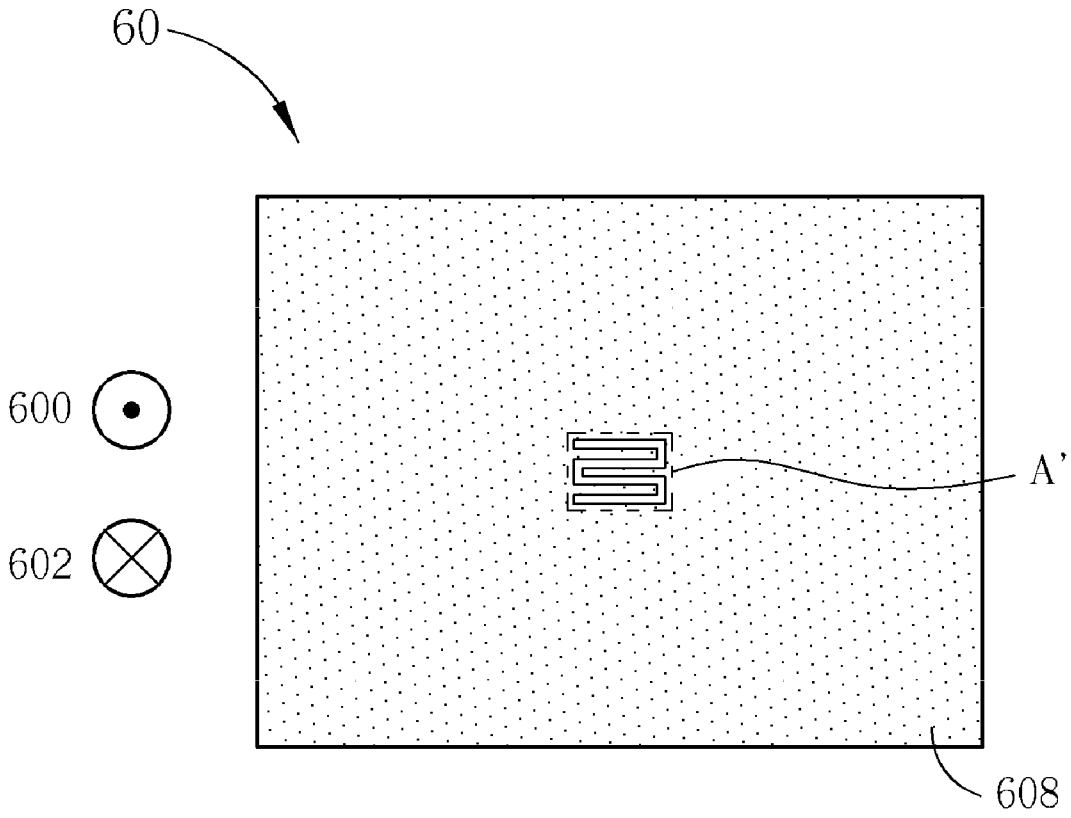
FIG. 6C is a bottom-view diagram of the filtering device shown in FIG. 6A.

Please refer to FIGS. 6A, 6B, and 6C. FIG. 6A is an exploded-view diagram of a filtering device 60 according to an embodiment of the invention, FIG. 6B is a vertical-view diagram of the filtering device 60, and FIG. 6C is a bottom-view diagram of the filtering device 60. FIGS. 6A, 6B, and 6C utilize arrows 600 and 602 for illustrating viewing angle of the filter device 60. The filtering device 60 includes an isolation substrate 604, a micro-strip line 606, and a ground metal layer 608. The micro-strip line 606 and the ground metal layer 608 are respectively formed in an upper plane and a bottom plane of the filtering device 60, and are used for transmitting signals and providing grounding. In the ground metal layer 608, an area A' is corresponding to an area A of the micro-strip line 606, and forms (via etching process) a meander-shaped resonating cavity 610 which is used for generating a rejection band on the micro-strip line 606. In a word, the meander-shaped resonating cavity 610 formed under of the area A is used for generating a rejection band, so the filtering device 60 can filter signals in a certain frequency band.

Figure 3:
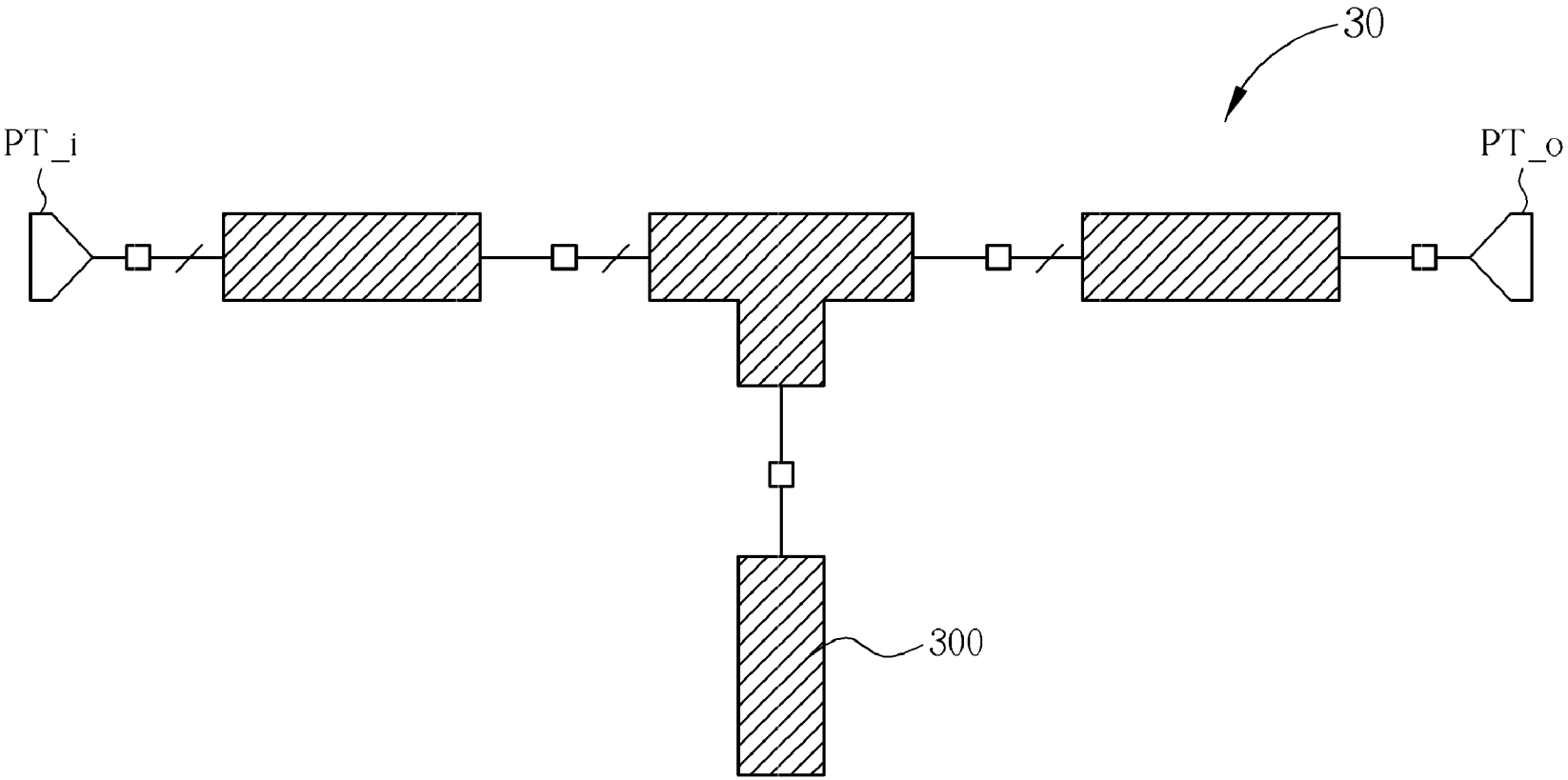
FIG. 3 PRIOR ART
FIG. 3 is a schematic diagram of a micro-strip line open stub structure.
Figure 4:
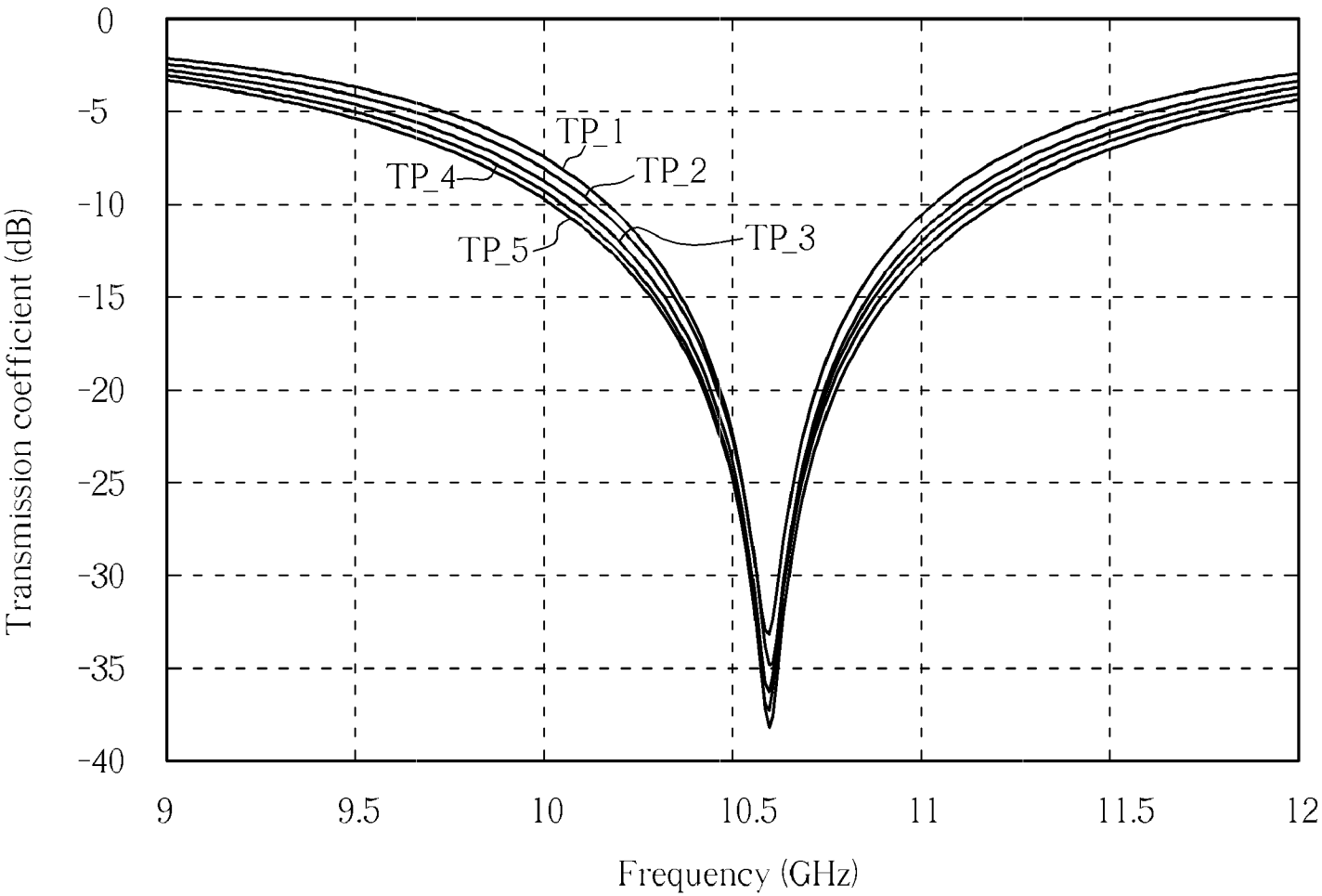
FIG. 4 PRIOR ART
FIG. 4 is a schematic diagram of transmission coefficients of an open stub in different line widths shown in FIG. 3.
Figure 5:
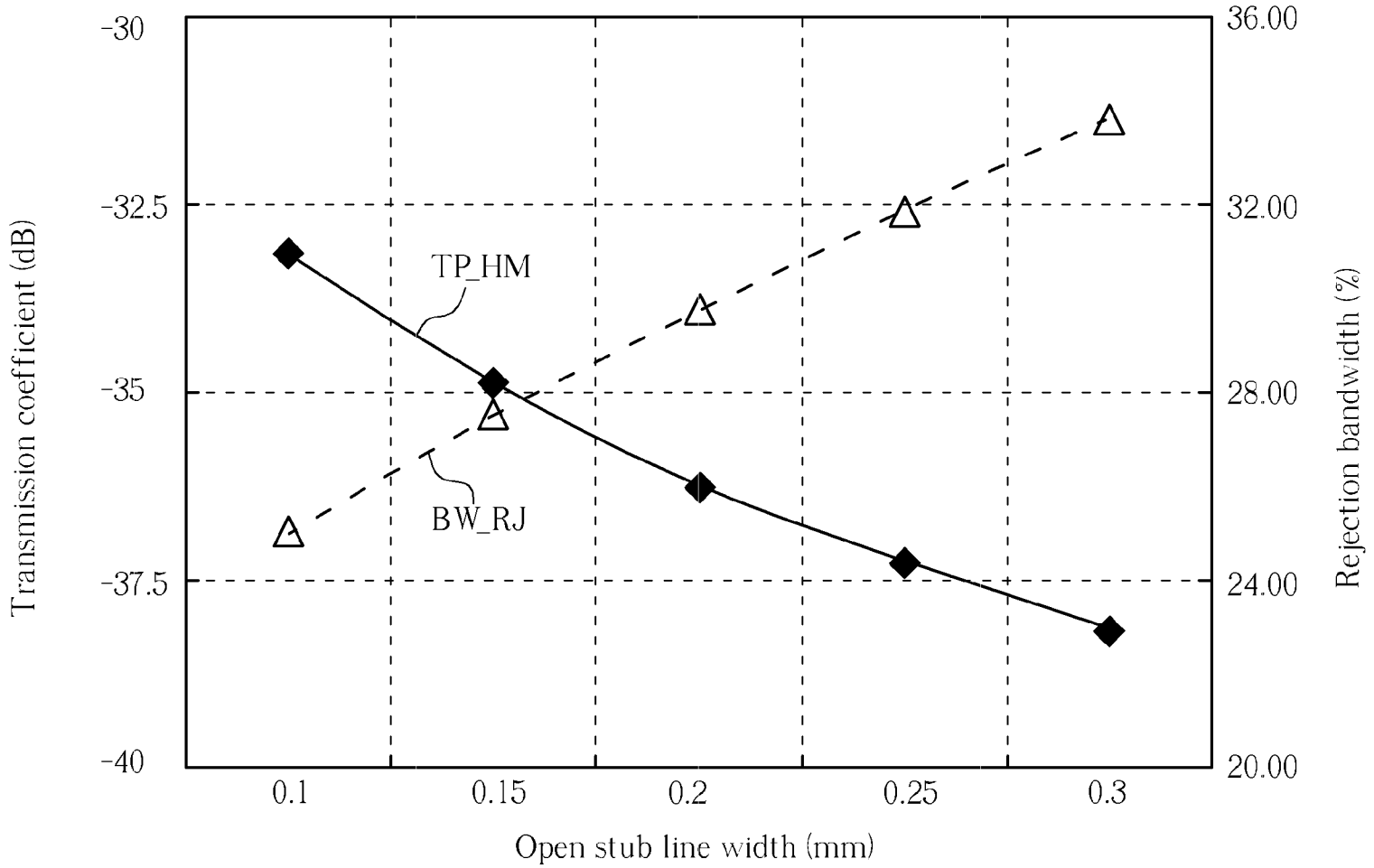
FIG. 5 PRIOR ART
FIG. 5 is a schematic diagram of rejection bandwidth of an open stub in different line widths shown in FIG. 3.
Figure 7:
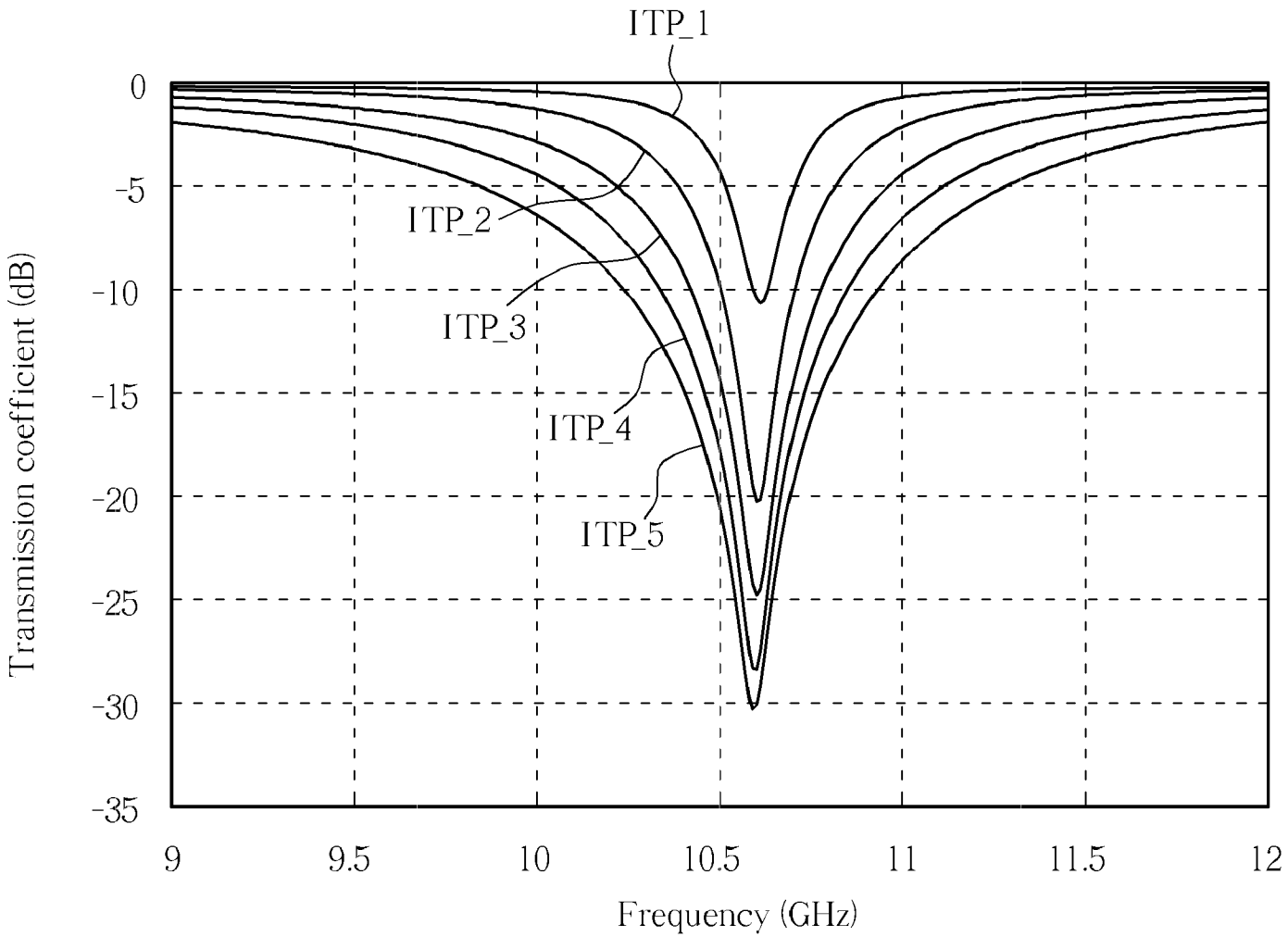
FIG. 7 is a schematic diagram of transmission coefficients of the filtering device shown in FIG. 6A in different intervals of a meander-shaped resonating cavity.
Figure 8:
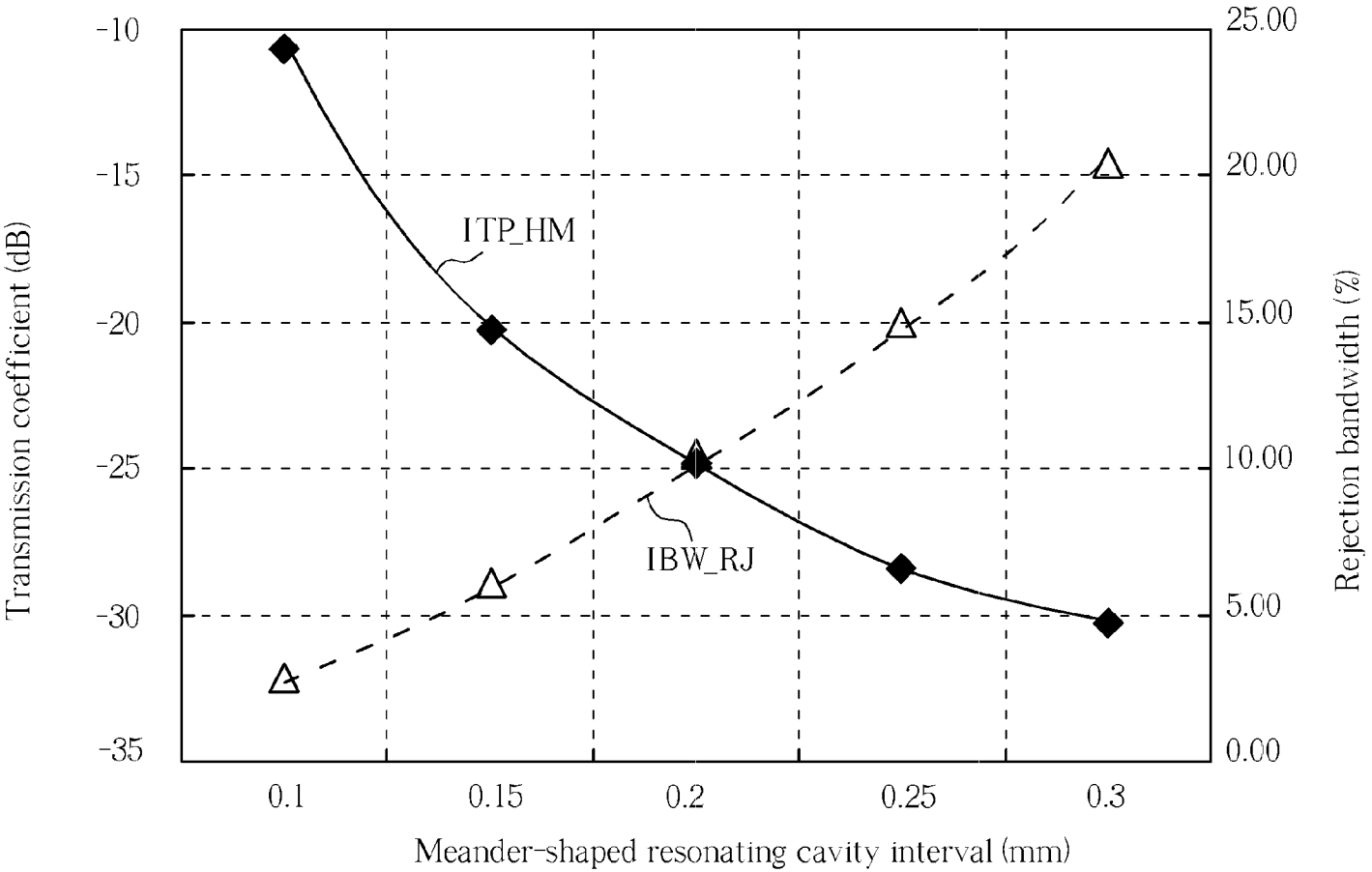
FIG. 8 is a schematic diagram of rejection bandwidths of the filtering device shown in FIG. 6A in different intervals of a meander-shaped resonating cavity.
Figure 9:
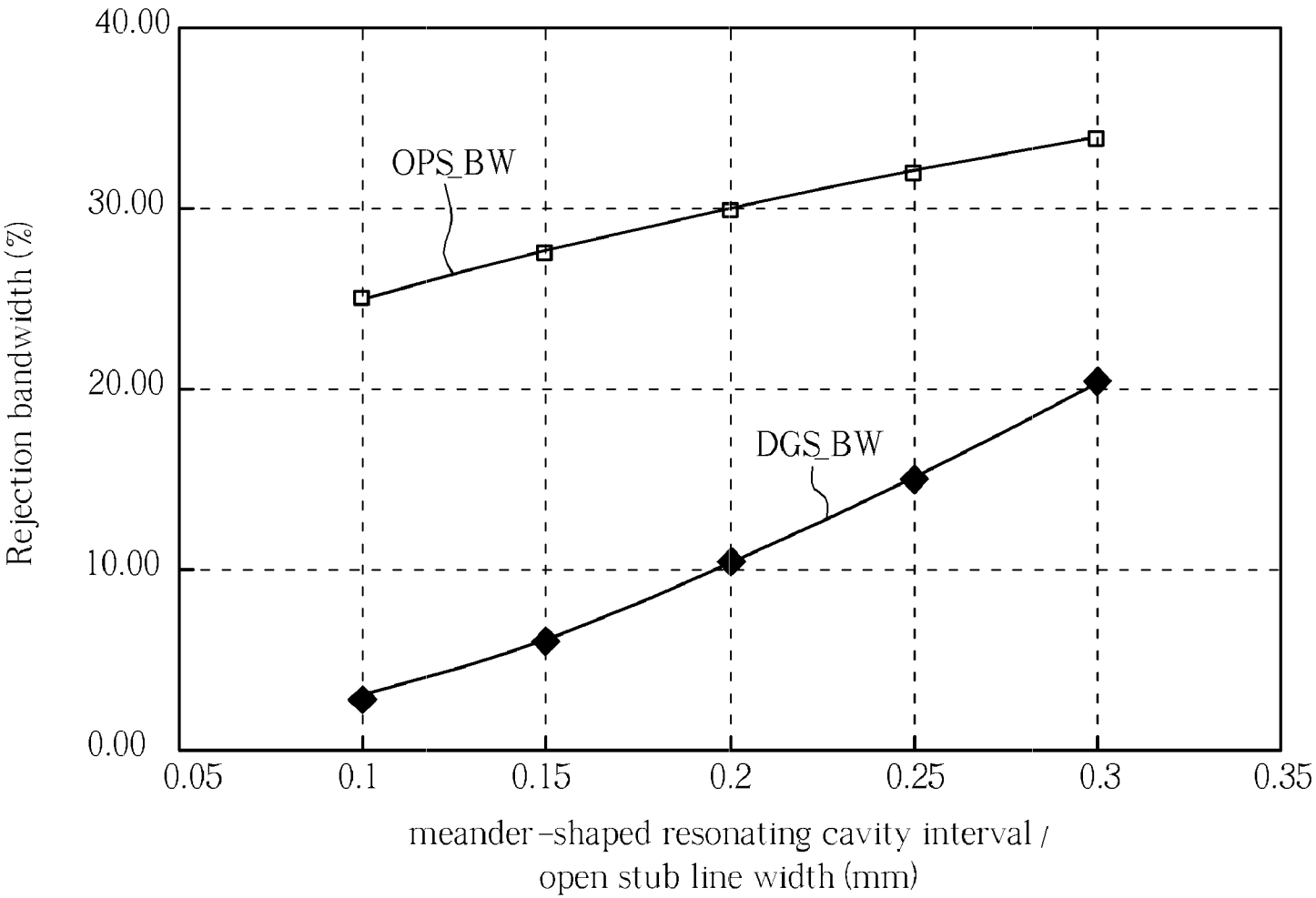
FIG. 9 is a diagram of a rejection bandwidth curve of the micro-strip line open stub structure shown in FIG. 3 compared with a rejection bandwidth curve of the filtering device shown in FIG. 6A.

In the filtering device 60, the meander-shaped resonating cavity 610 under the micro-strip line 606 is equivalent to a parallel circuit composed of a resistor, a capacitor, and an inductor. In other words, a bandwidth of a rejection band, a center frequency, a resonant point transmission coefficient, etc can be adjusted by adjusting an interval, a total length, etc of the meander-shaped resonating cavity 610. For example, please refer to FIG. 7 and FIG. 8 which are schematic diagrams of transmission coefficients and rejection bandwidths of the filtering device 60 in different intervals of the meander-shaped resonating cavity 610. FIG. 7 shows curves of transmission coefficients of the filtering device 60, and curves TP_1~TP_5 respectively indicate intervals of the meander-shaped resonating cavity 610 being 0.1 mm, 0.15 mm, 0.2 mm, 0.25 mm and 0.3 mm. FIG. 8 shows curves of resonant point transmission coefficients and rejection bandwidths of the filtering device 60, and curves ITP_HM and IBW_RJ respectively indicate intervals of the meander-shaped resonating cavity 610 being 0.1 mm, 0.15 mm, 0.2 mm, 0.25 mm and 0.3 mm. As can be seen from FIG. 7, when an interval of the meander-shaped resonating cavity 610 becomes smaller, a rejection band of the filtering device 60 becomes small too. The reason is that when an interval of the meander-shaped resonating cavity 610 becomes smaller, capacity will be increased and bandwidth of the rejection band is inverse proportional to product of equivalent resistance and capacitance, so the bandwidth of the rejection band becomes smaller. In addition, as can be seen from FIG. 8, when an interval of the meander-shaped resonating cavity 610 becomes smaller, bandwidth of the rejection band becomes small drastically, for example, when an interval from 0.30 mm lowered to 0.10 mm, bandwidth of the rejection band reduces about 17%. Moreover, to compare with the micro-strip line open stub structure 30 shown in FIG. 3, please refer to FIG. 9, which is a diagram of a rejection bandwidth curve OPS_BW of the micro-strip line open stub structure 30 compared with a rejection bandwidth curve DGS_BW of the filtering device 60. As can be seen from FIG. 9, a speed of the rejection band of the filtering device 60 reducing bandwidth is twice of the micro-strip line open stub structure 30. In other words, a bandwidth of the rejection band can be adjusted effectively by proper adjusting an interval of the meander-shaped resonating cavity 610. In this situation, those skilled in the art can utilize the filtering device 60 for assisting a band pass filter to increase rejection ability, or install the filtering device 60 in the micro-strip line bottom for filtering interference out.

Figure 10A:
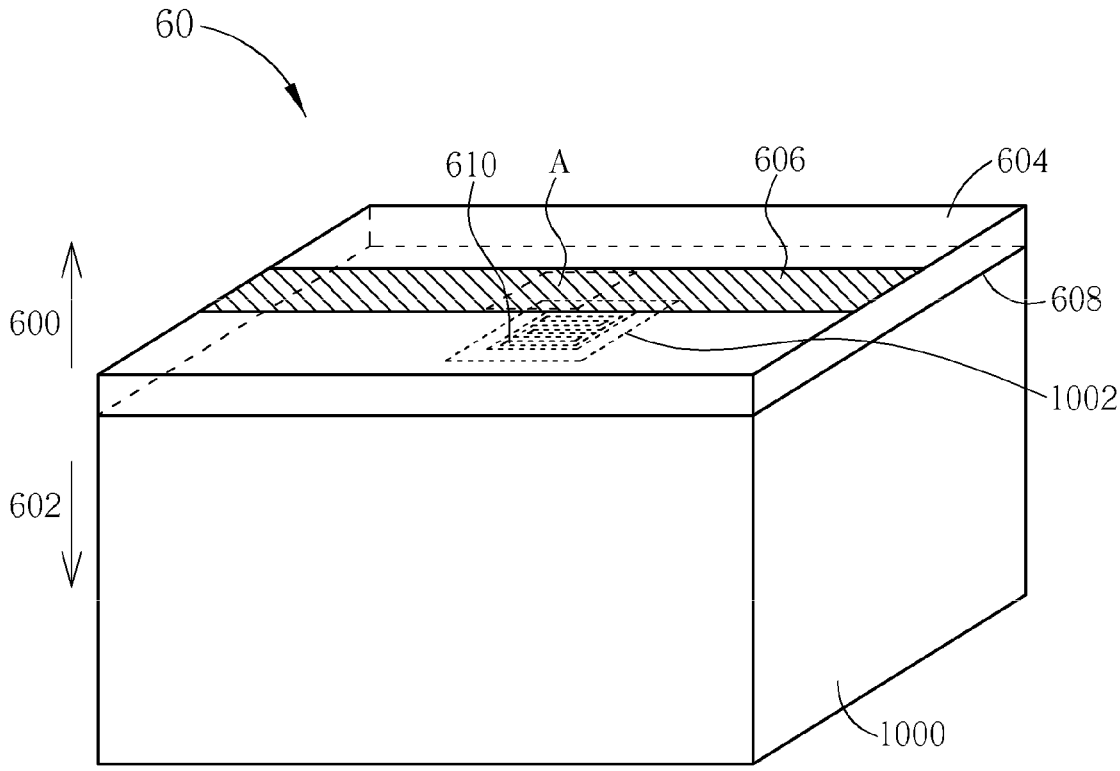
FIG. 10A is a schematic diagram of the filtering device shown in FIG. 6A covered by a housing.
Figure 10B:
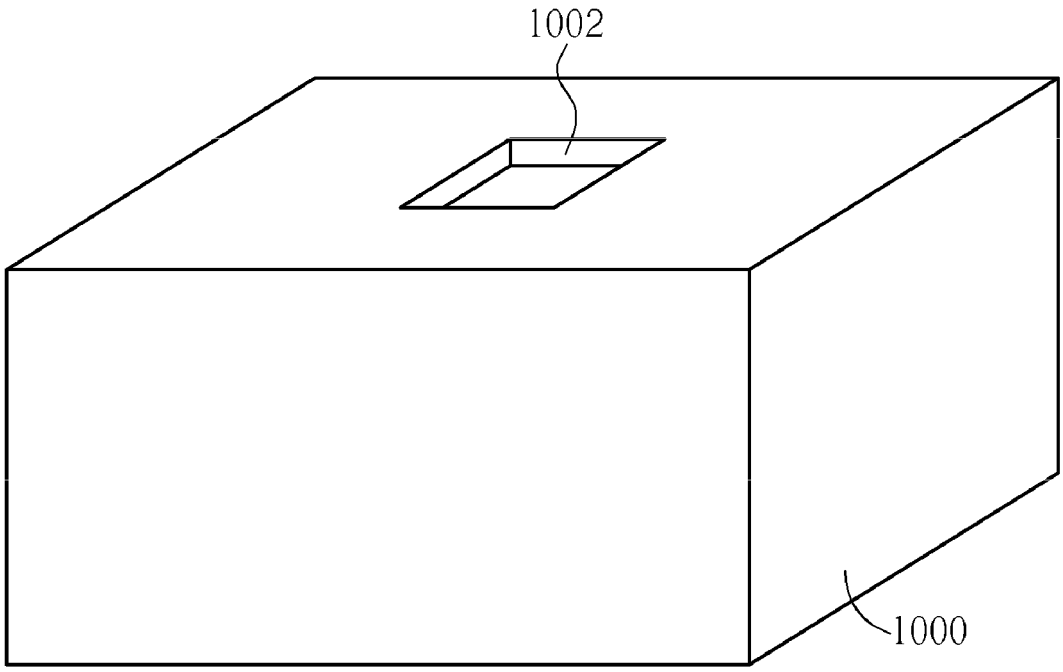
FIG. 10B is a schematic diagram of the housing shown in FIG. 10A.
Figure 11:
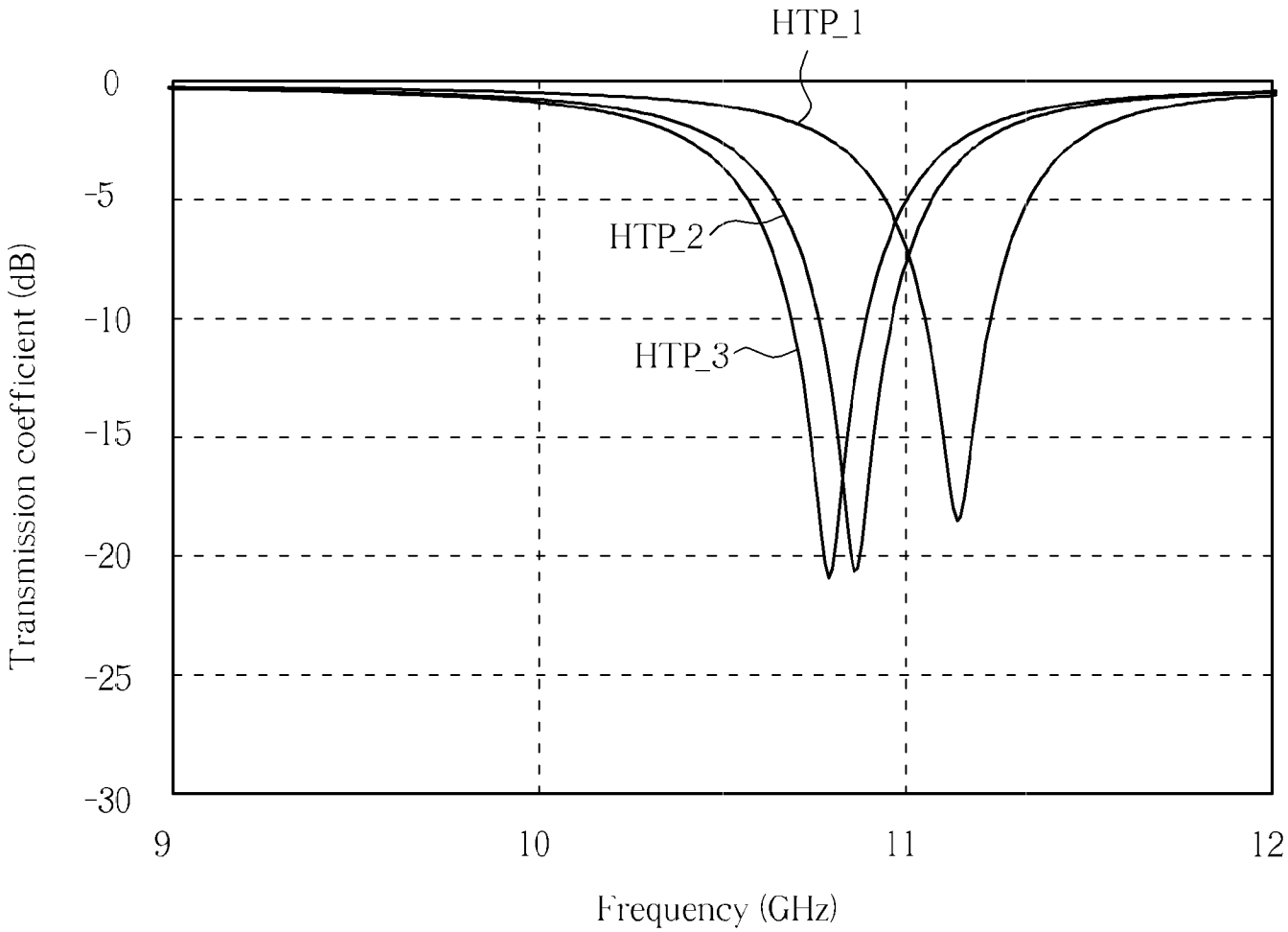
FIG. 11 is a schematic diagram of transmission coefficients of the filtering device shown in FIG. 6A in different depths of draght space.

In addition, for realizing the filtering device 60, a housing is usually used for covering the ground metal layer 608. Please refer to FIG. 10A and FIG. 10B. FIG. 10A is a schematic diagram of the filtering device 60 covered by a housing 1000, and FIG. 10B is a schematic diagram of the housing 1000. Since the meander-shaped resonating cavity 610 is formed in the ground metal layer 608, the housing 1000 includes a draght space 1002 whose area projected on the isolation substrate 604 is larger than area of the meander-shaped resonating cavity 610, to maintain a normal operation. Moreover, a depth of the draght space 1002 can change an inductance and a capacitance of an equivalent circuit of the meander-shaped resonating cavity 610; for example, FIG. 11 is a schematic diagram of transmission coefficients of the filtering device 60 in different depths of the draght space 1002. FIG. 11 shows curves of transmission coefficients of the filtering device 60, and curves HTP_1~HTP_3 respectively indicate depths of the draght space 1002 being 0.5 mm, 1.0 mm, and 2.0 mm. When a depth of the draght space 1002 is getting more superficial, a center frequency of a rejection band of the filtering device 60 is getting higher. Therefore, a center frequency of a rejection band of the filtering device 60 can be adjusted by properly adjusting a depth of the draght space 1002.

As can be seen, a bandwidth of a rejection band, a center frequency, a resonant point transmission coefficient, etc can be adjusted via adjusting an interval, a total length, a depth of the draght space 1002, etc of the meander-shaped resonating cavity 610. In other words, those skilled in the art can easily implement filtering characteristics according to different requirements. Certainly, besides adjustment method described above, an adjustment of the filtering device 60 can be combined with current adjustment method for enhancing adjustability of the filtering device 60. For example, in wireless radio frequency (RF) technique, a tuning screw is a common technique for tuning micro-strip line capacitance up or down. The tuning screw can be turned around to change equivalent capacitance between resonated circuit and the tuning screw, so as to adjust filtering characteristic. The tuning screw method can be used in the invention for increasing adjustability.

Figure 1:
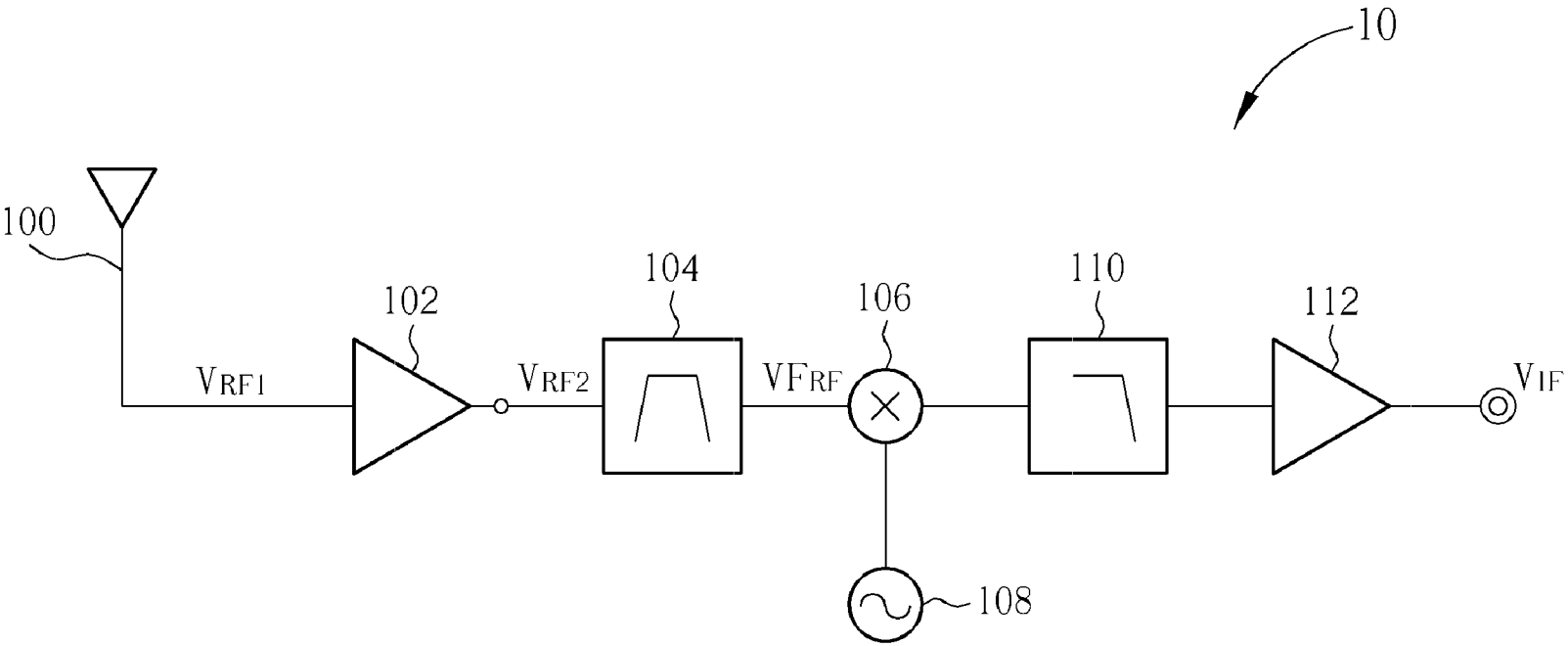
FIG. 1 PRIOR ART
FIG. 1 is a schematic diagram of a superheterodyne receiver according to the prior art.
Figure 2:
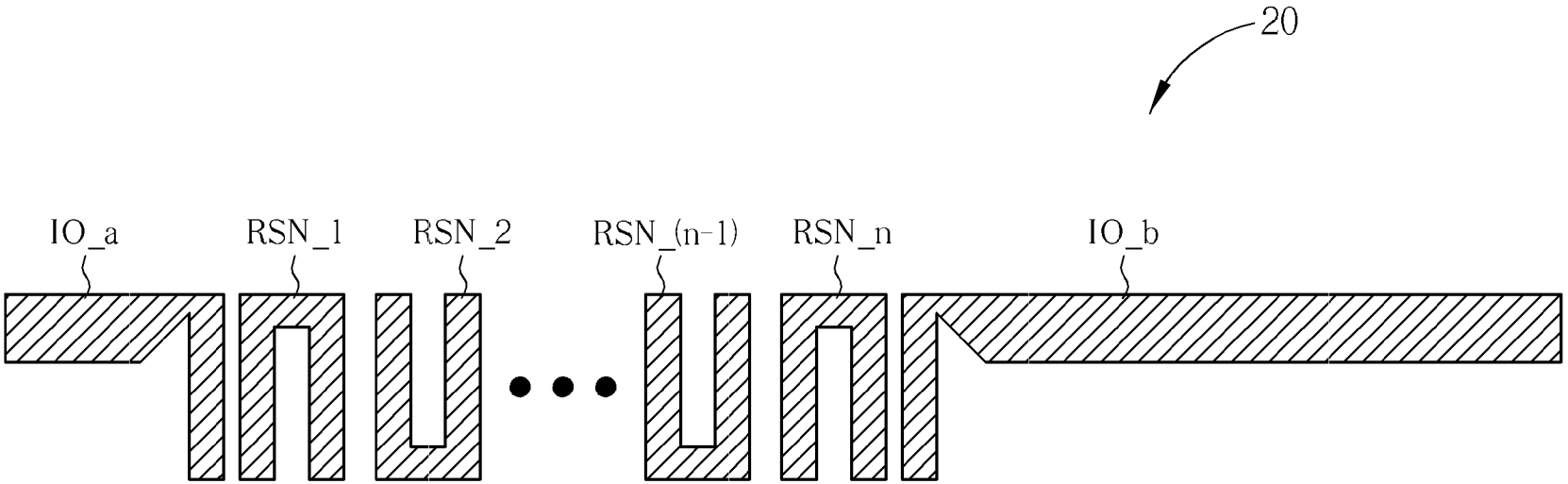
FIG. 2 PRIOR ART
FIG. 2 is a schematic diagram of a hairpin band pass filter according to the prior art

As mentioned above, the meander-shaped resonating cavity 610 is equivalent to a parallel circuit composed of a resistor, a capacitor, and an inductor, and this kind of equivalent circuit has higher Q value. Therefore, the bandwidth is narrower, so interference around the RF band can be easily rejected. By these characteristics, if the filtering device 60 is utilized in a wireless communication receiver, the filtering device 60 can replace a band pass filter (such as the hairpin band pass 20 shown in FIG. 2). Please refer to FIG. 12, which is a schematic diagram of a wireless communication receiver 1200 according to an embodiment of the invention. The wireless communication receiver 1200 utilizes the filtering device 60 of FIG. 6A, and includes an antenna 1202, a wave guide 1204, a frequency down converter 1206, and a baseband processor 1208. An operation method of the wireless communication receiver 1200 is described as follows. An RF signal is received by the antenna 1202, and an electric wave of a certain frequency band in the RF signal is enhanced via the wave guide 1204. Then the filtering device 60 of the invention filters out image frequency signals. Finally, RF signal is transformed to an IF (intermediate-frequency) band through the frequency down converter 1206, and then processed via the baseband processor 1208. In a word, the wireless communication receiver 1200 utilizes the wave guide 1204 and the filtering device 60 to replace the band pass filter. Since the filtering device 60 has advantages, such as a narrow rejection band, low occupation and low cost, etc, the filtering device 60 is easily embedded in a micro-strip circuit, so as to decrease circuit layout area, increase circuit performances, and lower cost.

Figure 12:
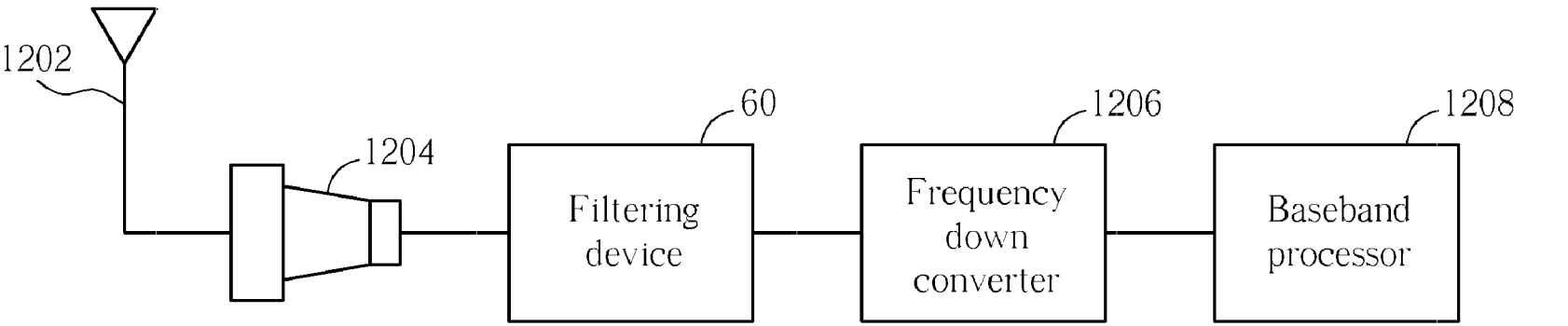
FIG. 12 is a schematic diagram of a wireless communication receiver according to an embodiment of the invention.

Note that, FIG. 12 is only a schematic diagram of the wireless communication receiver 1200. In practice, the wireless communication receiver 1200 includes other components, such as low noise amplifier, IF low pass filter, IF amplifier, etc. Those skilled in the art can make alternations and modifications accordingly.

In conclusion, the invention forms a meander-shaped resonating cavity at a ground metal layer under a micro-strip line, to generate a rejection band, so as to make the filtering device 60 filtering signals in a certain bandwidth. Therefore, the filtering device 60 of the invention not only has advantages, such as a narrow rejection band, low occupation and low cost, etc, but also is easily embedded in a micro-strip circuit, so as to decrease circuit layout area, increase circuit performances, and lower cost. The most important is that the filter device of the invention has higher adjustability, and filtering characteristics can be adjusted via kinds of adjustment method, to fulfill system requirements.

Those skilled in the art will readily observe that numerous modifications and alterations of the device and method may be made while retaining the teachings of the invention.

What is claimed is:

1. A filtering device comprising:

an isolation substrate comprising a first plane and a second plane;

a micro-strip line, deposited on the first plane of the isolation substrate, for transmitting signals; and a ground metal layer, deposited on the second plane of the isolation substrate, for providing grounding;

wherein a meander-shaped resonating cavity is formed in an area of the ground metal layer confined within an area of the micro-strip line, for generating a rejection band on the micro-strip line.

2. The filtering device of claim 1, wherein an interval of the meander-shaped resonating cavity is direct proportional to a bandwidth of the rejection band.

3. The filtering device of claim 1, wherein an interval of the meander-shaped resonating cavity is inverse proportional to a resonant point transmittal coefficient of the filtering device.

4. The filtering device of claim 1, wherein a total length of the meander-shaped resonating cavity corresponds to a center frequency of the rejection band.

5. The filtering device of claim 1, wherein the meander-shaped resonating cavity is formed in the ground metal layer by an etching process.

6. The filtering device of claim 1 further comprising a housing covering the ground metal layer.

7. The filtering device of claim 6 further comprising a draght space formed in an area of the housing corresponding to an area of the meander-shaped resonating cavity.

8. The filtering device of claim 7, wherein an area of the draght space projected on the second plane of the isolation substrate is larger than an area of the meander-shaped resonating cavity.

9. The filtering device of claim 7, wherein a depth of the draght space is inverse proportional to a center frequency of the rejection band.

10. The filtering device of claim 1 further comprising a tuning screw set in the isolation substrate, for adjusting a distance between the tuning screw and the micro-strip line, to adjust a center frequency of the rejection band.

11. A wireless communication receiver comprising:

an antenna, for receiving a wireless signal;

a wave guide, coupled to the antenna, for enhancing an electric wave of a certain frequency band in the wireless signal;

a frequency down converter, for reducing a frequency of the wireless signal, to output an IF (intermediate-frequency) signal;

a baseband processor, for processing the IF signal; and a filtering device comprising:

an isolation substrate comprising a first plane and a second plane;

a micro-strip line, deposited on the first plane of the isolation substrate, for transmitting signals; and a ground metal layer, deposited on the second plane of the isolation substrate, for providing grounding;

wherein a meander-shaped resonating cavity is formed in an area of the ground metal layer confined within an area of the micro-strip line, for generating a rejection band on the micro-strip line.

12. The wireless communication receiver of claim 11, wherein an interval of the meander-shaped resonating cavity is direct proportional to a bandwidth of the rejection band.

13. The wireless communication receiver of claim 11, wherein an interval of the meander-shaped resonating cavity is inverse proportional to a resonant point transmittal coefficient of the filtering device.

14. The wireless communication receiver of claim 11, wherein a total length of the meander-shaped resonating cavity corresponds to a center frequency of the rejection band.

15. The wireless communication receiver of claim 11, wherein the meander-shaped resonating cavity is formed in the ground metal layer by an etching process.

16. The wireless communication receiver of claim 11 further comprising a housing covering the ground metal layer.

17. The wireless communication receiver of claim 16 further comprising a draght space formed in an area of the housing corresponding to an area of the meander-shaped resonating cavity.

18. The wireless communication receiver of claim 17, wherein an area of the draght space projected on the second plane of the isolation substrate is larger than an area of the meander-shaped resonating cavity.

19. The wireless communication receiver of claim 17, wherein a depth of the draght space is inverse proportional to a center frequency of the rejection band.

20. The wireless communication receiver of claim 11 further comprising a tuning screw set in the isolation substrate, for adjusting a distance between the tuning screw and the micro-strip line, to adjust a center frequency of the rejection band.

* * * * *